US005320015A

United States Patent [19]

Minichshofer et al.

[11] Patent Number: 5,320,015

[45] Date of Patent: Jun. 14, 1994

[54] APPARATUS FOR APPLYING A FLEECE BAND TO AN ENDLESSLY CIRCULATING SUPPORT WEB

[75] Inventors: Klaus Minichshofer, Linz; Peter Müller, Marchtrenk; Hannes Pum, Alberndorf, all of Austria

[73] Assignee: Textilmaschinenfabrik Dr. Ernst Fehrer Aktiengesellschaft, Leonding, Austria

[21] Appl. No.: 943,779

[22] Filed: Sep. 11, 1992

[30] Foreign Application Priority Data

Sep. 16, 1991 [AT] Austria ..... 1847/91

[51] Int. Cl.[5] ..... B26D 5/22; B65H 35/02

[52] U.S. Cl. ..... 83/425.4; 83/426; 242/56.3; 242/56.7; 242/57.1

[58] Field of Search ..... 83/72, 425.4, 428, 426; 242/56.3, 56.7, 57.1

[56] References Cited

U.S. PATENT DOCUMENTS

| | | | |
|---|---|---|---|
| 2,088,473 | 7/1937 | Gulliksen | 242/57.1 X |
| 2,672,198 | 3/1954 | Jones et al. | 242/57.1 X |
| 3,156,426 | 11/1964 | Brock | 242/57.1 X |
| 3,536,273 | 10/1970 | Hawkins | 242/56.7 |
| 3,774,491 | 11/1973 | Killilea | 83/428 X |
| 5,193,424 | 3/1993 | Minichshofer et al. | 83/75 |

FOREIGN PATENT DOCUMENTS

| | | | |
|---|---|---|---|
| 1043479 | 9/1966 | United Kingdom | 83/428 |

*Primary Examiner*—Eugenia Jones
*Assistant Examiner*—Raymond D. Woods
*Attorney, Agent, or Firm*—Collard & Roe

[57] ABSTRACT

Apparatus for applying a fleece band (1) to an endlessly circulating support web (2) in contiguous coils comprises a fleece band feed device (3) movable transversely relative to the support web (2) and an edging device (10) for the fleece band run supplied to the support web (2). To ensure a uniform fleece band feed in the edge zone of the support web (2), the edging device (10) comprises at least one edging cutter (15) which moves in the vicinity of the fleece band coil adjoining the support web edge at a relative speed in relation to the feed device (3) which corresponds to the relative cross-feed of the feed device (3) compared to the support web (2), but is opposite to this cross-feed.

2 Claims, 3 Drawing Sheets

APPARATUS FOR APPLYING A FLEECE BAND TO AN ENDLESSLY CIRCULATING SUPPORT WEB

The invention relates to apparatus for applying a fleece band to an endlessly circulating support web in contiguous coils, comprising a fleece band feed device movable transversely relative to the support web and an edging device for the fleece band supplied to the support web.

Since in order to form contiguous fleece band coils the fleece band must be supplied to the endlessly circulating support web at a certain angle of inclination, difficulties arise in the marginal zone of the support web when it is necessary to ensure a single- or multi-layer fleece band feed distributed uniformly over the width of the support web. If, to form the marginal fleece band coil, the fleece band is supplied within the width of the support web, the angle of inclination of the fleece band relative to the support web produces a tapering edge strip of support web which is not covered by the fleece band, and which must subsequently be severed, something which should if at all possible be avoided in view of the relatively high cost of the support web. If however the fleece band is at first supplied outside the width of the support web, there is the problem that, while this avoids any such uncovered tapering strip on the support web, the fleece band run supplied now lies in the zone projecting beyond the support web edge on the unmoved guide table for the support web, so producing friction-related braking forces which may interfere with the entrainment of the fleece band run by the circulating supporting web and therefore with accurate feeding of this run on the support web. There may also be wrong drafts within the run.

The problem underlying the invention is therefore to improve apparatus for applying a fleece band to an endlessly circulating support web of the type initially described with simple means so as to ensure an accurate fleece band feed on to the support web, without thereby necessitating undesirable trimming of the support web.

The invention solves the problem posed in that the edging device comprises at least one edging cutter which moves in the vicinity of the fleece band coil adjoining the support web edge at a relative speed in relation to the feed device which corresponds to the relative cross-feed of the feed device compared to the support web, but is opposite to this cross-feed.

With such relative motion of an edging cutter in relation to the feed device, the edging cutter can be guided at a desired lateral distance from the longitudinal edge of the support web, so that the fleece band run approaching this edging cutter can be trimmed "edge-parallel" relative to the support web irrespective of the transverse motion of the feed device. This ensures a uniform fleece feed even in the marginal zone of the support web, without any risk of the fleece band distorting due to being fed outside the width of the support web. If the support web moves only in the circulatory direction and not also in the transverse direction, respective fixed edging cutters may be used for tapered edging of the marginal fleece band coils. If an additional transverse movement of the support web is possible, these blades would of course be required to follow the cross-feed of the support web.

In order to avoid having to provide, in addition to the edging cutters for parallel edging, separate edging cutters for edging the marginal fleece band coils which otherwise project beyond the width of the support web, the two edging cutters of the edging device associated with the feed device may each be separately slidable over the width of the fleece band contrary to the cross-feed of the feed device at the time, by way of separately drivable transverse drives. If, in the marginal zone of the support web, it is necessary to trim the relevant outer edge of the fleece band run supplied to the support web, at the angle of inclination at which the run is fed to the support web, that edging cutter of the edging device associated with this edge can be simply adjusted across the width of the fleece band towards the other edging cutter contrary to the cross-feed, in order to effect the required outer edge trimming of the fleece band run. Since such trimming of the fleece band is necessary in the vicinity of both edges of the support web, each edging cutter must have its own individually operable transverse drive.

The possible transverse adjustment of the edging cutters (beyond the customary adjustment of the fleece band width) during the edging process also has the advantage that the longitudinal course of the fleece band coil applied during the previous revolution of the support web can be allowed for when edging the margin of the fleece band, so as to give precisely contiguous coils. To this end the edging cutter for the leading edge of the fleece band run merely needs to be adjusted to the fleece band coils already applied, according to the transverse course of the free longitudinal edge of the fleece band coil applied during the preceding revolution of the support web. If the free longitudinal edge line of the fleece band coil applied is found to be deviating from the set position, it is possible for that edge of the supplied run which is to be laid on this longitudinal edge to be trimmed to compensate diametrically opposite the deviation, which allows fault-free contiguity of the individual fleece band coils.

The subject of the invention is illustrated by way of example in the drawings, in which.

Figure 1:
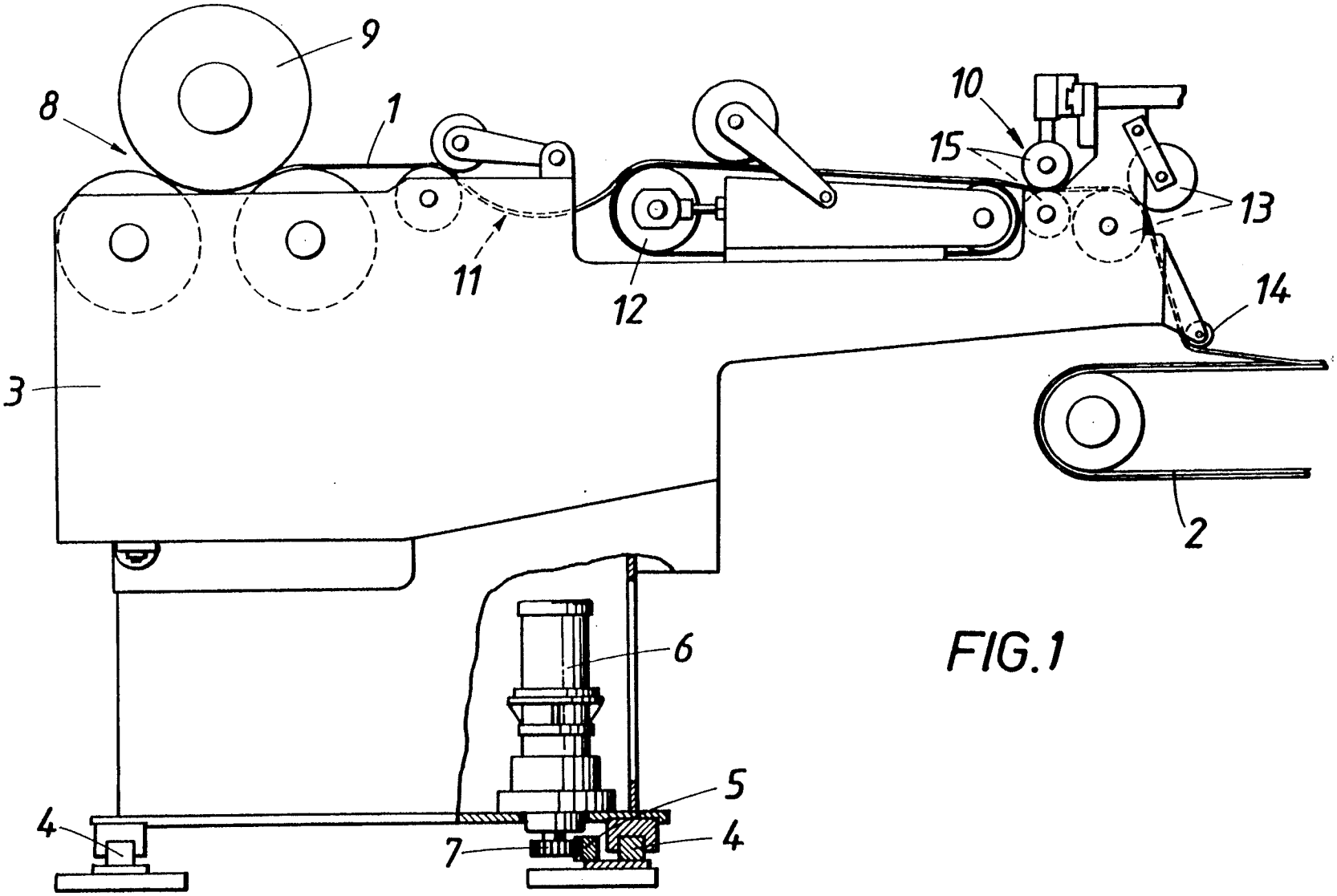
FIG. 1 is a diagrammatic side view of apparatus embodying the invention for applying a fleece band to an endlessly circulating support web.

The illustrated apparatus for applying a fleece band 1 to an endlessly circulating support web 2 comprises essentially a feed device 3 for the fleece band 1, this feed device being movable along a rail guide 4 transversely relative to the support web 2, which is guided round deflecting rollers and connected together to form a tube. The drive for this feed device 3 is a rack 5 parallel to the rail guide 4 and meshing with a pinion 7 driven by a motor 6. The feed device itself comprises an unwinding device 8 for a fleece band roll 9 and an edging device 10 for the fleece band run 1 which is unwound from the roll 9, and which runs to the support web 2. The run drawn off the roll 9 passes first through a freely sagging section 11, to allow compensation of internal tensions due to winding, before it passes on to a belt conveyor 12, between which and a draw-off roller pair 13 the fleece band 1 is subjected to traction so that it can be trimmed accurately with the edging device 10. The trimmed run is then passed over deflection means 14 to the support web 2.

Figure 2:
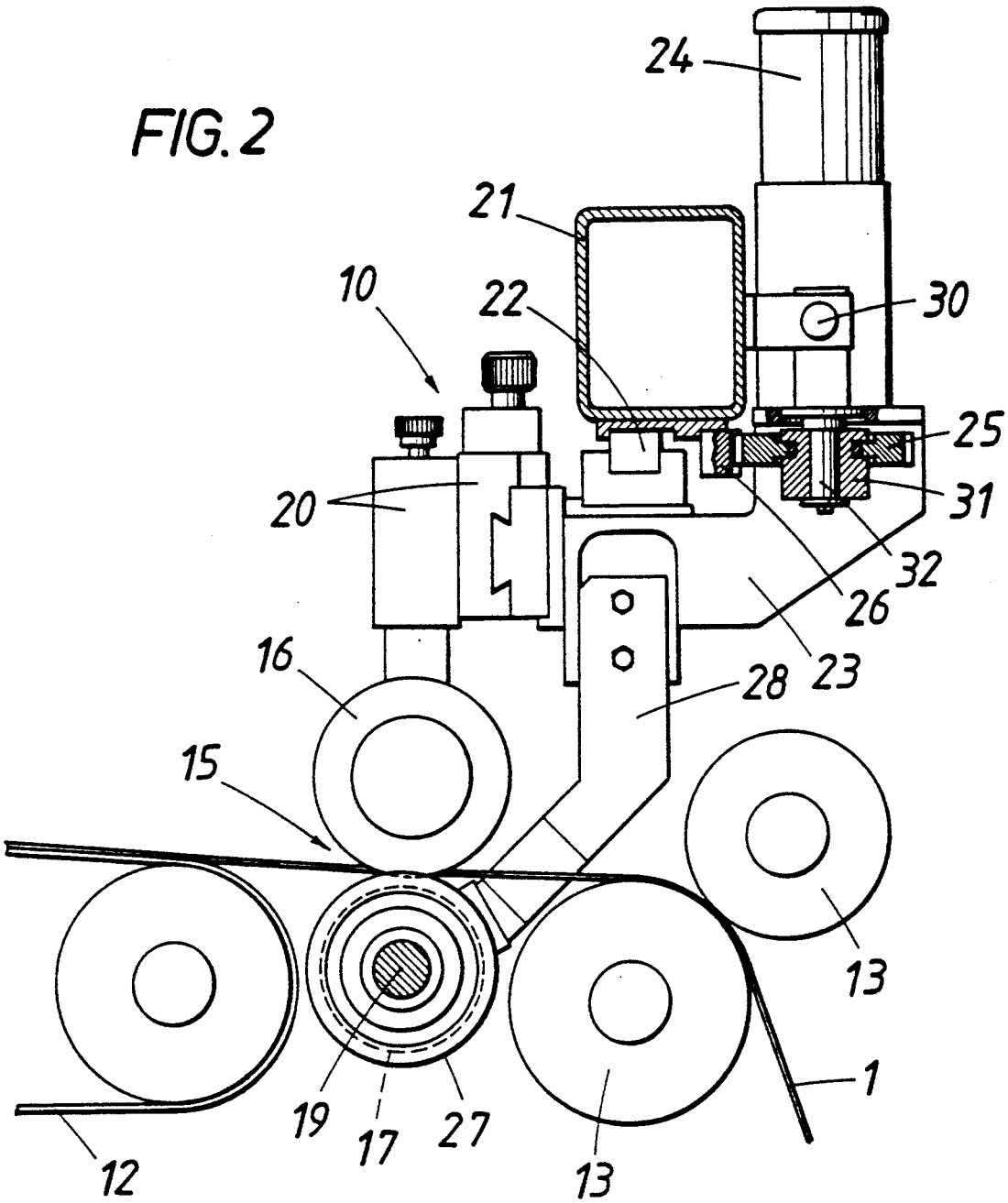
FIG. 2 illustrates in this apparatus the edging device associated with the feed device, in section along a line II—II in FIG. 3, and on a larger scale.

The purpose of the edging device 10 is to ensure that the longitudinal edge of the fleece band run supplied to the support web follows a straight course, since of course it cannot be assumed that the fleece band 1 unwound from the roll 9 has a uniform width or straight edge over its length. To this end edging cutters 15 are provided on each side of the fleece band 1, comprising respectively a cutter disc 16 and a counter blade 17. Whereas the counter blades 17 can be driven by way of a drive shaft 19 provided with a chain wheel 18, the cutter discs 16 in this embodiment are freely rotatably mounted, on a cross slide 20, to ensure a base setting for the edging cutters. In addition to this base setting for the edging cutters 15 the latter may be adjusted individually transversely relative to the fleece band 1, during the cutting operation. The feed device has, as a design solution to this problem, a cross beam 21 which carries a longitudinal guide 22 for the two edging cutters 15 which combine with the associated drives to form a respective structural unit. Each of these structural units comprises a frame 23 which is mounted on the longitudinal guides 22, and on which is mounted a drive motor 24 with a gearwheel 25 meshing with a rack 26 parallel to the guide 22 (FIG. 2). Since the counter blade 17 of the edging cutters 15 must always be adjusted at the same time as the cutter disc 16, the counter blades 17 are axially slidable on the drive shaft 19 and connected by an entraining ring 27 to an adjusting arm 28 provided on the frame 23. The entraining rings 27 are mounted so as to be rotatable but not axially slidable on the blade mountings for the counter blades 17, so that with the adjustment of the frame 23 along the guide 22 both the cutter disc 16 and the counter blade 17 of each edging cutter undergo a corresponding transverse shift. The cross slides 20 are used to set the cutter discs relative to the counter blades 17. Due to this adjustability of the edging cutters 15 during the cutting operation, the fleece band run supplied to the support web 2 can be trimmed to a desired edge line. This can advantageously be utilized to trim the marginal fleece band coils according to the edge line of the support web 2, so that the marginal fleece band coils can be laid down up to the edge of the support web, because the tapering fleece band strip which otherwise projects beyond the width of the support web is cut off before being fed onto the support web and is carried away in a conventional manner. The position of the edging cutters 15 required for constant lateral spacing relative to the edge of the support web is ensured by means of their transverse drive, which shifts the associated frame 23 with the cross-feed of the feed device 3, but contrary to this cross-feed.

In addition the transverse shift of the edging cutters 15 may be utilized to trim the fleece band run supplied to the support web 2 according to a non-straight edge line, when this run is to be applied to a previously applied fleece band coil of which the edge line contains irregularities. To this end the edging cutter concerned can be adjusted according to the transverse course of the free longitudinal edge of the coil on to which the trimmed fleece band run is to be applied.

Figure 3:
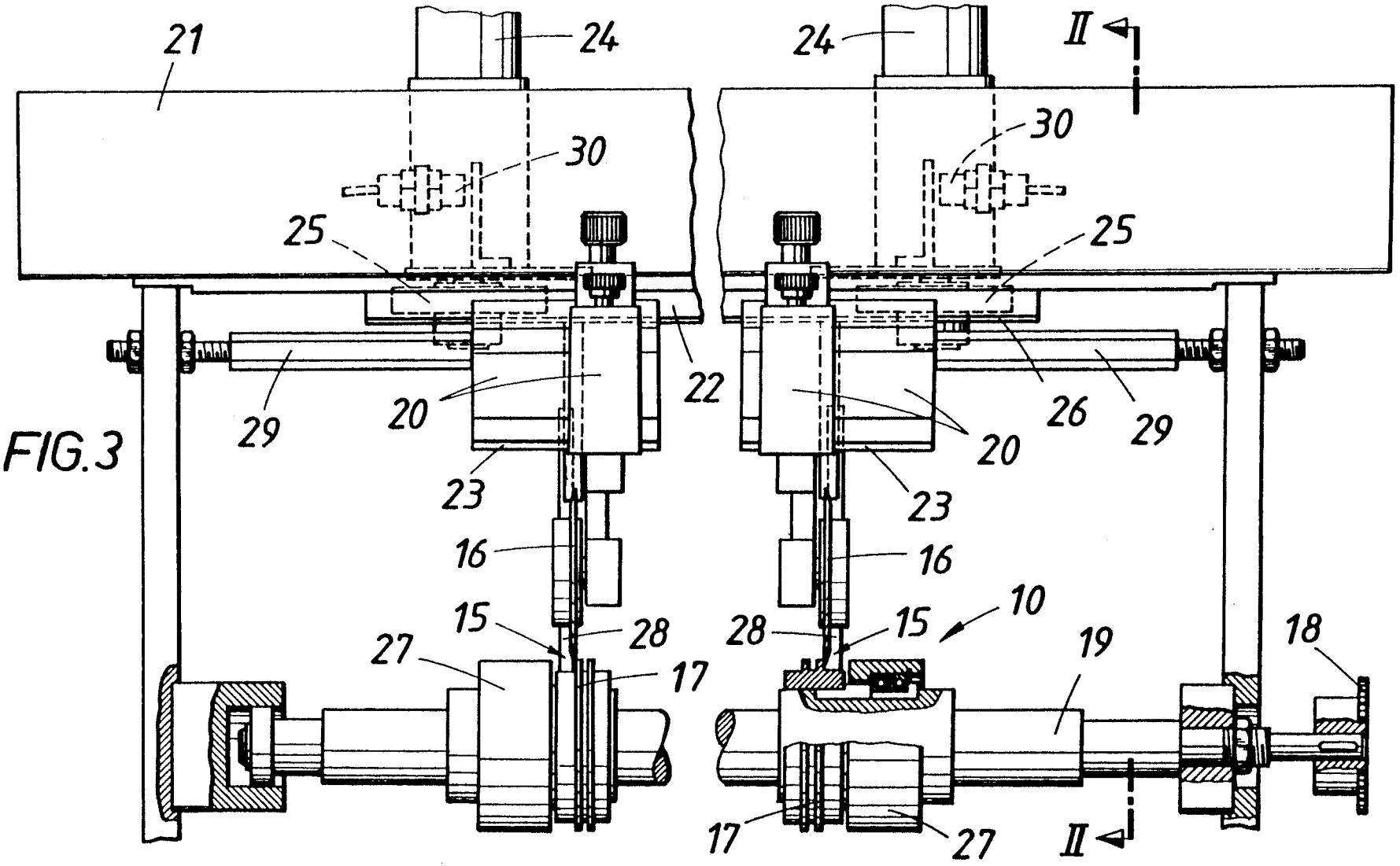
FIG. 3 shows this edging device in the direction of the passage of the fleece band, in elevation with part cut away.

As FIG. 3 indicates, the limit positions of the edging cutters 15, set for the maximum width, are fixed by stops 29. By means of proximity switches 30, the approach to these limit positions can be monitored and used to switch off the drives 24. To exclude mechanical damage the gearwheels 25 may be connected to the drive shaft 32 by friction clutches 31, as shown in FIG. 2.

We claim:

1. An apparatus for applying a fleece band having a width defined between two longitudinally extending edges to an endlessly circulating support web extending in a longitudinal direction, the support web having a width defined between two longitudinally extending edges and substantially exceeding the width of the fleece band, the fleece band being applied to the support web in continuous coils including a fleece band coil adjoining a respective one of the support web edges, the apparatus comprising (a) a fleece band feed device movable transversely to the longitudinal direction in a first direction at a predetermined speed, (b) an edging device for a respective one of the longitudinal fleece band edges, the edging device comprising (1) an edging cutter movable in the vicinity of the adjoining fleece band coil in a direction opposite to the first direction at a speed corresponding to the predetermined speed, and (c) means for maintaining said edging device stationary with respect to the longitudinal direction while said fleece band feed device moves at said predetermined speed and said edging cutter moves at said corresponding speed.

2. The apparatus of claim 1, wherein the edging device comprises a respective one of said edging cutters associated with each longitudinal fleece band edge, and further comprising a separately operable drive for slidably adjusting each edging cutter transversely to the one fleece band edge.

* * * * *